US010255854B2

(12) United States Patent
Park et al.

(10) Patent No.: US 10,255,854 B2
(45) Date of Patent: Apr. 9, 2019

(54) ORGANIC LIGHT EMITTING DISPLAY DEVICE WITH AUXILIARY PIXELS TO REPAIR DEFECTIVE DISPLAY PIXELS

(71) Applicant: SAMSUNG DISPLAY CO., LTD., Yongin-si, Gyeonggi-do (KR)

(72) Inventors: Kyong-Tae Park, Yongin-si (KR); Dong-Yoon So, Yongin-si (KR); Sung-Ho Cho, Yongin-si (KR); Yu-Hyun Cho, Yongin-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 0 days.

(21) Appl. No.: 15/709,672

(22) Filed: Sep. 20, 2017

(65) Prior Publication Data

US 2018/0012544 A1 Jan. 11, 2018

Related U.S. Application Data

(62) Division of application No. 14/792,921, filed on Jul. 7, 2015, now Pat. No. 9,792,856.

(30) Foreign Application Priority Data

Oct. 1, 2014 (KR) ..... 10-2014-0132454

(51) Int. Cl.
*G09G 3/30* (2006.01)
*G09G 3/3233* (2016.01)

(52) U.S. Cl.
CPC ... *G09G 3/3233* (2013.01); *G09G 2300/0847* (2013.01); *G09G 2310/0224* (2013.01);
(Continued)

(58) Field of Classification Search
CPC ..... G09G 3/3233; G09G 2320/0233; G09G 2300/0847; G09G 2360/16;
(Continued)

(56) References Cited

U.S. PATENT DOCUMENTS 9,129,923 B1 * 9/2015 Han ..... H01L 27/3248
2006/0007768 A1 1/2006 Kim
(Continued)

FOREIGN PATENT DOCUMENTS

KR 10-0666639 B1 1/2007
KR 10-2014-0030455 A 3/2014

OTHER PUBLICATIONS

Choi, Sangmoo, et al. "Sample and Hold Demultiplexing Method for AMOLED Threshold Voltage Compensation Pixel Circuits", IDW '2009, pp. 693-696.

*Primary Examiner* — Kwang-Su Yang
(74) *Attorney, Agent, or Firm* — Lee & Morse P.C.

(57) ABSTRACT

An organic light emitting display device includes a display area and a non-display area. The display area includes display pixels at crossing areas of data lines, scan lines, and emission control lines. The non-display area includes auxiliary pixels at crossing positions of auxiliary data lines, scan lines, and emission control lines. The display device also includes a scan driver to supply scan signals to the scan lines, a first data driver to supply data voltages to the data lines, a second data driver to supply an auxiliary data voltage to the auxiliary data line, and a demultiplexer between the data lines and the first data driver.

5 Claims, 10 Drawing Sheets

(52) U.S. Cl.
CPC ..... *G09G 2310/0297* (2013.01); *G09G 2320/0233* (2013.01); *G09G 2330/10* (2013.01); *G09G 2360/16* (2013.01)

(58) Field of Classification Search
CPC ..... G09G 2310/0297; G09G 2330/10; G09G 2310/0224
See application file for complete search history.

(56) References Cited

U.S. PATENT DOCUMENTS

| | | | | |
|---|---|---|---|---|
| 2011/0069061 | A1 | 3/2011 | Nakamura | |
| 2011/0127409 | A1 | 6/2011 | Sakakibara et al. | |
| 2011/0242143 | A1 | 10/2011 | Yamashita et al. | |
| 2012/0001950 | A1 | 1/2012 | Kim | |
| 2012/0019500 | A1* | 1/2012 | Hwang ..... | G09G 3/3233 345/211 |
| 2012/0026143 | A1 | 2/2012 | Jang | |
| 2014/0062988 | A1 | 3/2014 | Lee et al. | |
| 2015/0161943 | A1* | 6/2015 | Shim ..... | G09G 3/3225 345/76 |
| 2016/0078811 | A1* | 3/2016 | Park ..... | G09G 3/3233 345/78 |

* cited by examiner

ORGANIC LIGHT EMITTING DISPLAY DEVICE WITH AUXILIARY PIXELS TO REPAIR DEFECTIVE DISPLAY PIXELS

CROSS-REFERENCE TO RELATED APPLICATIONS

This is a divisional application based on pending application Ser. No. 14/792,921, filed Jul. 7, 2015, the entire contents of which is hereby incorporated by reference.

Korean Patent Application No. 10-2014-0132454, filed on Oct. 1, 2014, entitled, "Organic Light Emitting Display Device," is incorporated by reference herein in its entirety.

BACKGROUND

1. Field

One or more embodiments described herein relate to an organic light emitting display device.

2. Description of the Related Art

An organic light emitting display device generates images using pixels arranged at intersections of data lines and scan lines. Each pixel emits light with a luminance that is based on the amount of current supplied to an organic light emitting diode. The amount of current is determined based on a data voltage from a corresponding one of the data lines.

In operation, a defect may occur in the transistors of the pixels during manufacture of the organic light emitting display device. Production yield is significantly degraded as a result. In an attempt to increase yield, a method has been proposed to repair defective pixels using auxiliary pixels. For example, when a pixel is determined to be defective, the pixel may be connected to an auxiliary pixel.

In this type of repair method, transistors of the defective pixel and the organic light emitting diode are disconnected, and transistors of the auxiliary pixel are connected to an anode electrode of the organic light emitting diode of the defective pixel using an auxiliary line. As a result, it may be possible for the organic light emitting diode of the defective pixel to emit light by driving the transistors of the auxiliary pixel. However, this method may not be sufficient because of deviations in luminance from the pixel.

Another repair method involves connecting the output terminal of a data driver to a plurality of data lines and then distributing data voltages to the data lines using a demultiplexer. In this case, even though the same data voltage is supplied to the repaired pixel and any one display pixel, a difference may occur between the voltage supplied to a control electrode of a driving transistor of a repaired pixel and the voltage supplied to a control electrode of a driving transistor of the display pixel. This difference may result from a coupling difference between an auxiliary data line connected to an auxiliary pixel and a data line connected to the display pixel. Accordingly, there is a problem in that there is a difference in luminance between the repaired pixel and the display pixel.

SUMMARY

In accordance with one or more embodiments, an organic light emitting display device includes data lines and auxiliary data lines; scan lines and emission control lines crossing the data lines and the auxiliary data lines; a display area including display pixels at crossing areas of the data lines, the scan lines, and the emission control lines; a non-display area including auxiliary pixels at crossing positions of the auxiliary data lines, the scan lines, and the emission control lines; a scan driver to supply scan signals to the scan lines; a first data driver to supply data voltages to the data lines; a second data driver to supply an auxiliary data voltage to the auxiliary data line; and a demultiplexer between the data lines and the first data driver.

The demultiplexer may divide data voltages output from one output buffer of the first data driver for p data lines. The demultiplexer may include p demux transistors between one output buffer of the first data driver and the p data lines. The display device may include an auxiliary circuit between the auxiliary data line and the second data driver. The auxiliary circuit may include q auxiliary transistors connected between the auxiliary data line and any one output buffer of the second data driver in parallel, where q may be a positive integer equal to or greater than 2.

A first control signal may be supplied to a control electrode of any one demux transistor among the p demux transistors, a second control signal may be supplied to a control electrode of another demux transistor, the first control signal may be supplied to a control electrode of one auxiliary transistor of the q auxiliary transistors, and the second control signal may be supplied to a control electrode of another auxiliary transistor.

The first and second control signals may be generated based on a cycle of one horizontal period, and the first control signal may be generated before the second control signal within the one horizontal period. The value of q may be 1. The first control signal may be supplied to a control electrode of one demux transistor among the p demux transistors, a second control signal may be supplied to a control electrode of another demux transistor, one of the first or second control signals may be supplied to control electrodes of the q auxiliary transistors. The first and second control signals may be generated on a cycle of one horizontal period, and the first control signal may be generated before the second control signal within the one horizontal period.

The parasitic capacitance of each of the p demux transistors may be less than parasitic capacitance of each of the p data lines, and parasitic capacitance of the auxiliary data line may be less than parasitic capacitance of a spider line connected to the auxiliary data line. The first and second data drivers may be implemented as one drive integrated circuit.

In accordance with one or more other embodiments, an apparatus includes a display pixel connected to one data line, two scan lines, and one emission control line; and an auxiliary pixel connected to one auxiliary data line, two scan lines, and one emission control line, wherein the auxiliary pixel is to control emission of light from the display pixel when the display pixel is defective. The apparatus may include a first data driver to supply data voltages to the one data line; a second data driver to supply an auxiliary data voltage to the one auxiliary data line; and a demultiplexer between the one data line and the first data driver.

The apparatus may include an auxiliary circuit between the auxiliary data line and the second data driver, the auxiliary circuit including auxiliary transistors connected between the one auxiliary data line and an output buffer of the second data driver. The apparatus may include an auxiliary line to connect to the display pixel to the auxiliary pixel, wherein the auxiliary line is to transfer a signal to the display pixel when a pixel circuit of the display pixel is disconnected from a light emitter of the display pixel, the signal to cause the display pixel to emit light. The one auxiliary data line may transfer auxiliary data to the auxiliary pixel when the display pixel is defective, the auxiliary data may be generated based on digital video data and coordinate data of the display pixel.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
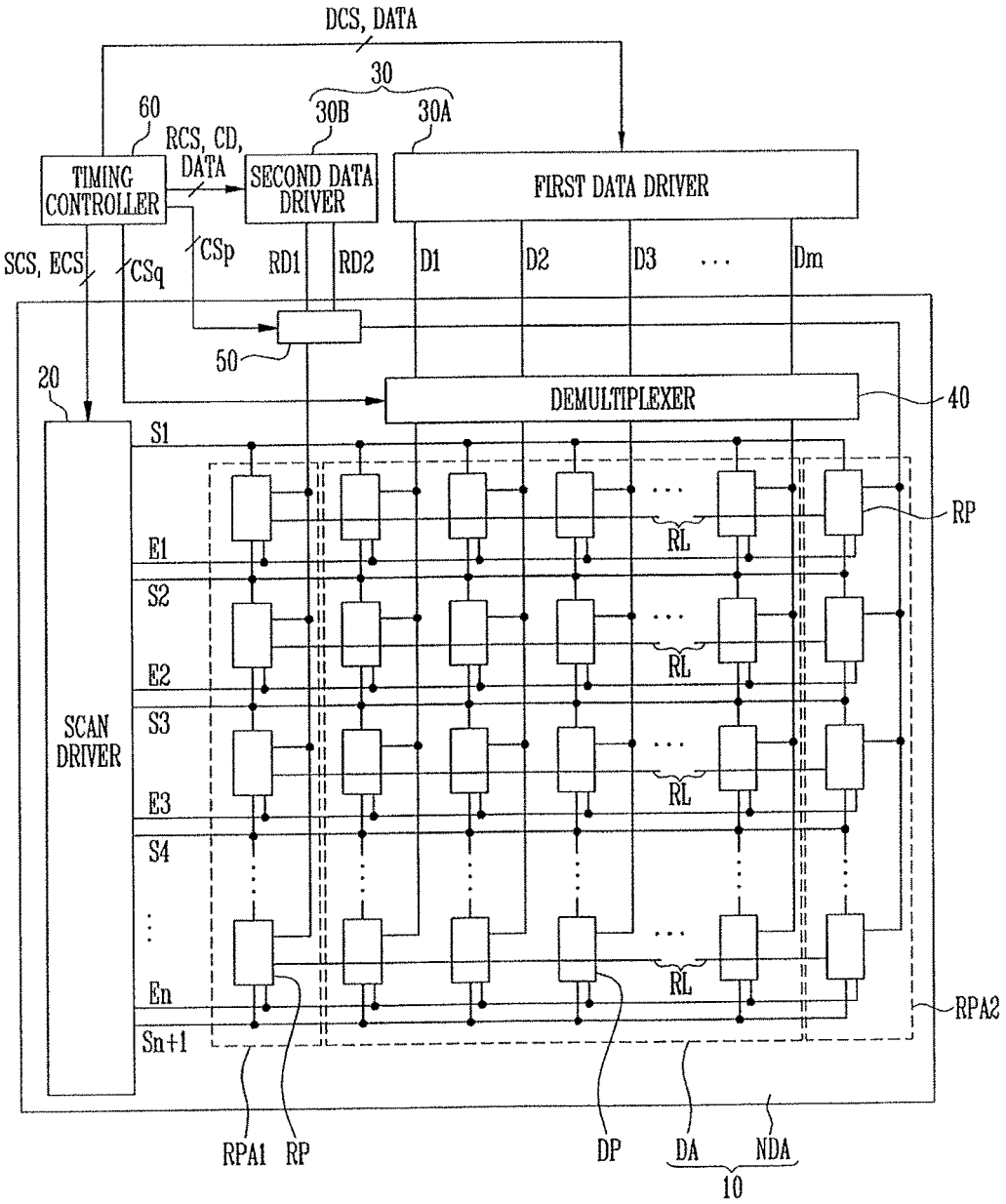
FIG. 1 illustrates an embodiment of an organic light emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

FIG. 1 illustrates an embodiment of an organic light emitting display device which includes a display panel 10, a scan driver 20, a data driver 30, a demultiplexer driver 40, an auxiliary circuit unit 50, and a timing controller 50.

Figure 2:
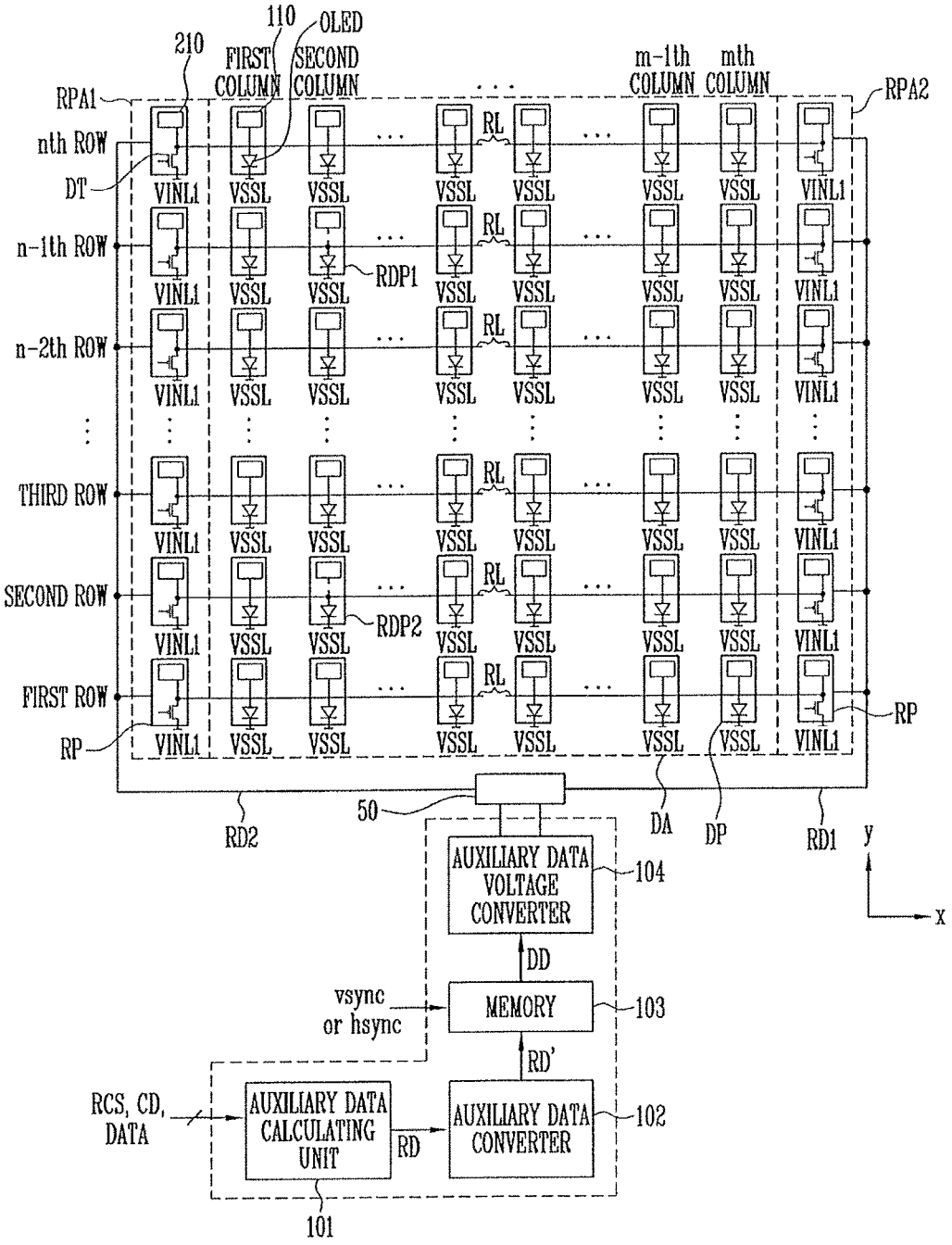
FIG. 2 illustrates an embodiment of display pixels, auxiliary pixels, auxiliary lines, auxiliary data lines, and a driver.

The display device also includes various signal lines. The signal lines include data lines D1 to Dm (m is a positive integer equal to or greater than 2), auxiliary data lines RD1 and RD2, scan lines S0 to Sn (n is a positive integer equal to or greater than 2), and emission control lines E1 to En. The data lines D1 to Dm and the auxiliary data lines RD1 and RD2 may be parallel to each other. The auxiliary data lines RD1 and RD2 may be at outer sides of the data lines D1 to Dm. (For example, as illustrated in FIG. 2, the first auxiliary data line RD1 may be at an outer side of one side of the data lines D1 to Dm, and the second auxiliary data line RD2 may be at an outer side of the other side of the data lines D1 to Dm.) The data lines D1 to Dm and the scan lines S0 to Sn may cross each other. The auxiliary data lines RD1 and RD2 and the scan lines S0 to Sn may also cross each other. The scan lines S0 to Sn and the emission control lines E1 to En may be parallel to each other.

The display panel 10 includes a display area DA including display pixels DPs for displaying an image and a non-display area NDA which it outside the display area DA. The non-display area NDA may include first and second auxiliary pixel areas RPA1 and RPA2 which include auxiliary pixels RPs for repairing the display pixels DPs. The auxiliary pixels RPs are connected to a first auxiliary data line RD1 and are in a first auxiliary pixel area RPA1. The auxiliary pixels RPs are connected to a second auxiliary data line RD2 and are in a second auxiliary pixel area RPA2.

The display pixels DPs are arranged in a matrix at crossing areas of the data lines D1 to Dm and the scan line S0 to Sn in the display area DA. Each of the display pixels DPs is connected to one data line, two scan lines, and one emission control line.

The auxiliary pixels RPs are at crossing areas of the auxiliary data lines RD1 and RD2 and the scan lines S0 to Sn in each of the auxiliary pixel areas RPA1 and RPA2. The auxiliary pixels RPs are to be used for repairing defective ones of the display pixels DPs. A defect may occur, for example, during a process of fabricating the display panel 10. Each auxiliary pixel RP is connected to one auxiliary data line, two scan lines, one emission control line, and one auxiliary line RL. The auxiliary line RL is connected to the auxiliary pixel RP and extends to the display area DA from the auxiliary pixel RP to cross the display pixels DPs.

When a display pixel DP is defective, the display pixel DP is connected to the auxiliary line RL, for example, through a laser short-circuit process. Accordingly, the auxiliary pixel RP may be connected to the defective display pixel DP through the auxiliary line RL and the display pixel DP is repaired using the auxiliary pixel RP. (A defective pixel DP which has been repaired may be referred to as a repaired pixel).

The display panel may also include power voltage lines for supplying power voltages to the display pixels DPs, and the auxiliary pixels RPs may be formed in the display panel 10.

The scan driver 20 includes a scan signal output unit for outputting scan signals to the scan lines S0 to Sn, and an emission control signal output unit for outputting emission control signals to the emission control lines E1 to En. The scan signal output unit receives a scan timing control signal SCS from the timing controller 60, and outputs the scan signals to the scan lines S0 to Sn according to the scan timing control signal SCS. The emission control signal output unit receives an emission timing control signal ECS from the timing controller 60, and outputs the emission control signals to the emission control lines E1 to En according to the emission timing control signal ECS.

The scan signal output unit and the emission control signal output unit may be formed in an Amorphous Silicon Gate in Pixel (AGS) scheme or a Gate Driver in Panel (GIP) scheme in the non-display area NDA of the display panel 10. In this case, each of the scan signal output unit and the emission control signal output unit may include subordinately connected scan stages. The scan stages may sequentially output the scan signals to the scan lines S0 to Sn, and emission stages may sequentially output the emission control signals to the emission control lines E1 to En.

The data driver 30 includes first and second data drivers 30A and 30B. The first data driver 30A includes at least one source drive Integrated Circuit (IC). The source drive IC receives digital video data DATA and a source timing control signal DCS from the timing controller 60. The source drive IC converts the digital video data DATA to data voltages based on the source timing control signal DCS. The source drive IC outputs data voltages through output buffers.

The second data driver 30B receives a repair control signal RCS, digital video data DATA, and coordinate data CD of the repaired pixel from the timing controller 60. The second data driver 30B generates auxiliary data voltages using the repair control signal RCS, digital video data DATA, and the coordinate data CD of the repaired pixel. The second data driver 30B outputs auxiliary data voltages through output buffers. For example, the second data driver 30B supplies the same auxiliary data voltage as the data voltage, which is to be supplied to the repaired pixel, to the auxiliary pixel connected to the repaired pixel in order to repair the repaired pixel.

The demultiplexer 40 is connected between the first data driver 30A and the data lines D1 to Dm. The demultiplexer 40 distributes the data voltages from each output buffer of the first data driver 30A to the data lines. For example, the demultiplexer 40 may distribute the data voltages output from each output buffer of the first data driver 30A to p data lines (p is a positive integer equal to or greater than 2). To this end, the demultiplexer 40 may include p demux transistors connected between the respective output buffers of the first data driver 30A and the p data lines.

The auxiliary circuit unit 50 is connected between the second data driver 30B and the auxiliary data lines RD1 and RD2. The auxiliary circuit unit 50 includes q auxiliary transistors (p is a positive integer) connected between the respective output buffers of the second data driver 30B and the respective auxiliary data lines.

The timing controller 60 receives the digital video data DATA and timing signals, for example, from an external source. The timing controller 60 generates timing control signals for controlling the scan driver 30 and the first data driver 30A based on the timing signals. The timing control signals includes a scan timing control signal SCS for controlling an operation timing of the scan signal output unit of the scan driver 30, an emission timing control signal ECS for controlling an operation timing of the emission control signal output unit of the scan driver 20, and a data timing control signal DCS for controlling an operation timing of the first data driver 30A. The timing controller 60 outputs the scan timing control signal SCS and the emission timing control signal ECS to the scan driver 20, and outputs the data timing control signal DCS and the digital video data DATA to the first data driver 30A.

Further, the timing controller 60 generates the repair control signal RCS and the coordinate data CD of a repaired pixel. The repaired control signal RCS indicates whether a pixel has been repaired. For example, when a pixel has been repaired (e.g., when a repaired pixel exists), the repair control signal RCS may have a first logic level voltage. When the pixel has not been repaired (e.g., a repaired pixel does not exist), the repair control signal RCS may have a second logic level voltage.

The coordinate data CD of a repaired pixel indicates a coordinate value of a repaired pixel. The coordinate data CD of a repaired pixel may be stored, for example, in a memory of the timing controller 60. The timing controller 60 outputs the repair control signal RCS, the coordinate data CD of the repaired pixel, and the digital video data DATA to the second data driver 30B.

Further, the timing controller 60 outputs p control signals CSp for controlling p demux transistors of the demultiplexer 40. The timing controller 60 outputs q control signals CSq for controlling q auxiliary transistors of the auxiliary circuit unit 50 to the auxiliary circuit unit 50.

The organic light emitting display device may further include a power supply source. The power supply source may supply a plurality of power voltages to the plurality of power voltage lines. Further, the power supply source may supply driving voltages to the scan driver.

FIG. 2 illustrating an embodiment of display pixels, auxiliary pixels, auxiliary lines, auxiliary data lines, and a second data driver. In FIG. 2, only the display pixels DPs, the auxiliary pixels RPs, the auxiliary lines RLs, the auxiliary data lines RD1 and RD2, and the second data driver 30B of the display panel 10 are illustrated for convenience of description.

Referring to FIG. 2, each of the display pixels DPs includes a display pixel driver 110 and an organic light emitting diode OLED. The display pixel driver 110 may be connected to at least one scan line, one data line, and a first power voltage line through which a first power voltage is supplied. When the scan signal is supplied from a scan line, the display pixel driver 110 receives the data voltage from the data line and controls a driving current flowing from the first power voltage to the organic light emitting diode OLED according to the data voltage. For example, the display pixel driver 110 supplies a predetermined driving current to the organic light emitting diode OLED.

The organic light emitting diode OLED emits light with predetermined luminance according to a driving current of the display pixel driver 110. An anode electrode of the organic light emitting diode OLED may be connected to the display pixel driver 110, and a cathode electrode may be connected to a second power voltage line VSSL to which a second power voltage is supplied. The first power voltage is a low-potential power voltage and the second power voltage is a high-potential power voltage.

Each auxiliary pixel RPs includes an auxiliary pixel driver 210 and a discharge transistor DT. The auxiliary pixel driver 210 and the discharge transistor DT are connected to the auxiliary line RL. The auxiliary pixel driver 210 may be connected to at least one scan line, one auxiliary line, and the first power voltage line to which the first power voltage is supplied. When a scan signal is supplied from the scan line, the auxiliary pixel driver 210 receives the auxiliary data voltage from the auxiliary data line and controls driving current to flow from the first power voltage to the organic light emitting diode OLED according to the auxiliary data voltage. For example, the auxiliary pixel driver 210 supplies a predetermined driving current to the auxiliary line RL.

The discharge transistor DT is connecter to third power voltage line VINL1 for supplying a third power voltage. The discharge transistor DT discharges the auxiliary line RL with the third power voltage. A control electrode of the discharge transistor DT may be connected to various signal lines.

As illustrated in FIG. 2, the auxiliary line RL is connected to the auxiliary pixel RP and extends to the display area DA from the auxiliary pixel RP to cross the display pixels DPs. For example, the auxiliary line RL may cross the anode electrodes of the organic light emitting diodes OLEDs of the display pixels DPs.

The auxiliary line RL may be connected to one of the display pixels DPs of the display area DA. The display pixel DP connected to the auxiliary line RL corresponds to a defective pixel which is subject to repair. In FIG. 2, the display pixel DP connected to the auxiliary line RL is defined as a repaired pixel RDP1/RDP2. For example, the auxiliary line RL may be connected to the anode electrode of the organic light emitting diode OLED of the repaired pixel RDP1/RDP2. In this case, the display pixel driver 110 and the organic light emitting diode OLED of the repaired pixel RDP1/RDP2 are disconnected.

The auxiliary pixels RPs of a first auxiliary pixel area RP1 are connected to the first auxiliary data line RD1. The auxiliary pixels RPs of the second auxiliary pixel area RP2 are connected to the second auxiliary data line RD2. The display pixels DPs of the display area DA are connected to the data lines D1 to Dm.

The auxiliary circuit unit 50 is connected between the second data driver 30B and the first and second auxiliary data lines RD1 and RD2. The auxiliary circuit unit 50 includes q auxiliary transistors connected between respective output buffers of the second data driver 30B and respective auxiliary data lines.

The second data driver 30B includes an auxiliary data calculating unit 101, an auxiliary data converter 102, a memory 103, and an auxiliary data voltage converter 104.

Figure 3:
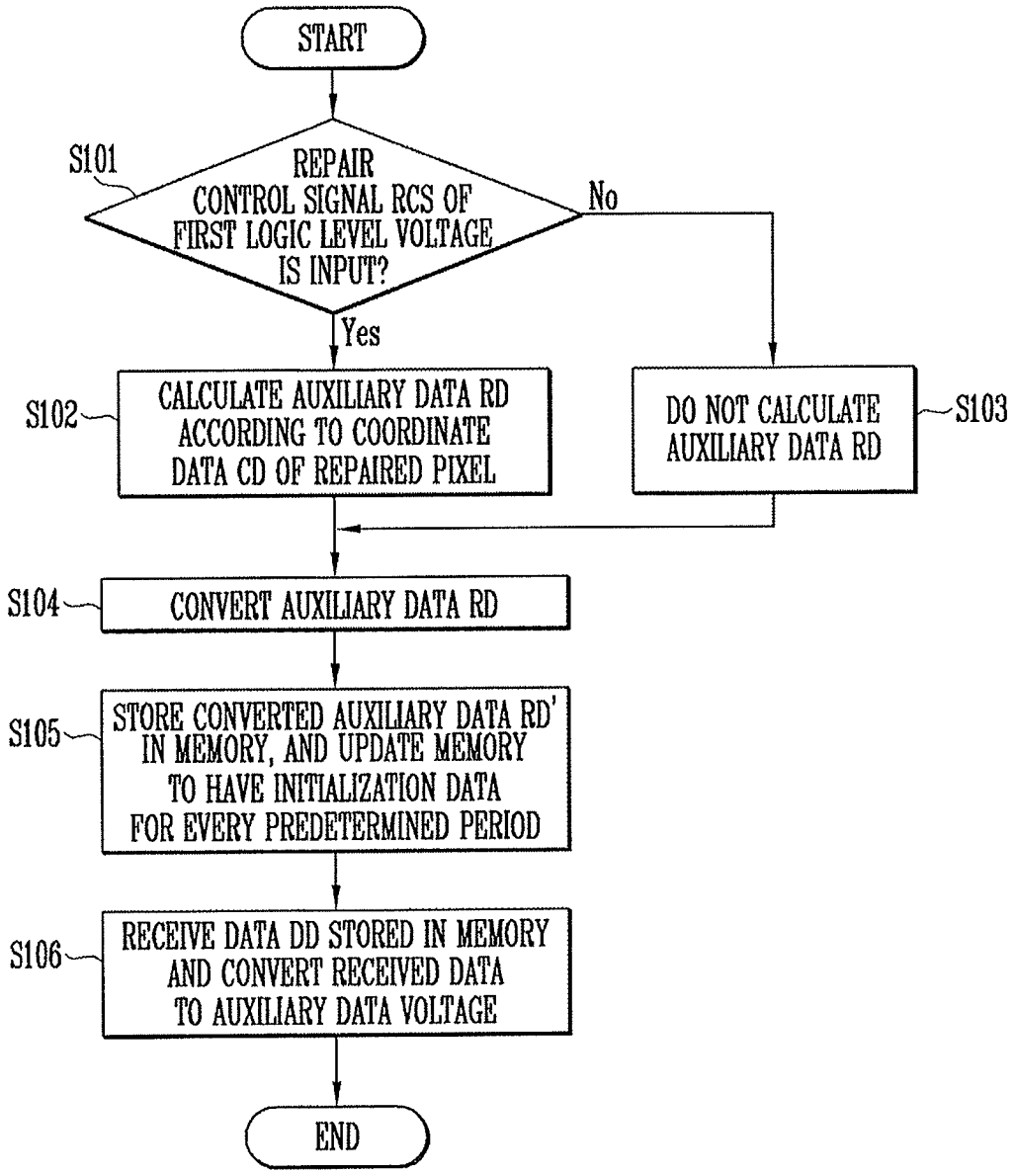
FIG. 3 illustrates an embodiment of a driving method of a data driver.

FIG. 3 illustrates an embodiment of a method for driving the second data driver of FIG. 2. Referring to FIG. 3, a driving method of the second data driver includes operations S101 to S106.

First, the auxiliary data calculator 101 receives a repair control signal RCS, digital video data DATA, and coordinate data CD of a repaired pixel RDP1/RDP2 from the timing controller 60. The auxiliary data calculating unit 101 calculates auxiliary data RD when the repair control signal RCS of the first logic level voltage is input, and does not calculate the auxiliary data RD when the repair control signal RCS of the second logic level voltage is input. For example, when the repair control signal RCS of the first logic level voltage is input, the auxiliary data calculating unit 101 calculates the auxiliary data RD from the digital video data DATA according to the coordinate data CD of the repaired pixel.

The auxiliary data calculating unit 101 may calculate the digital video data corresponding to a coordinate value of the repaired pixel RDP1/RDP2 as the auxiliary data RD. For example, when the first repaired pixel RDP1 is in the second row and the second column as in FIG. 2, a coordinate value of the first repaired pixel RDP1 may be (2, 2). In FIG. 2, only the row and the column of the display area DA is illustrated. Further, when n display pixels DPs are disposed in the column direction (a y-axis direction), the second repaired pixel RDP2 is in the $n-1^{th}$ row and the second column, and a coordinate value of the second repaired pixel RDP2 may be (n−1, 2).

The auxiliary data calculating unit 101 calculates digital video data that corresponds to the coordinate value (2, 2) as the auxiliary data RD to be supplied to the auxiliary pixel RP connected to the first repaired pixel RDP1, and digital video data that corresponds to the coordinate value (n−1, 2) as the auxiliary data RD to be supplied to the auxiliary pixel RP connected to the second repaired pixel RDP2. The auxiliary data calculating unit 101 outputs the calculated auxiliary data RD to the auxiliary data converter 102 (S101, S102, and S103).

Second, the auxiliary data converter 102 receives the auxiliary data RD from the auxiliary data calculating unit 101. In this case, the repaired pixel RDP1/RDP2 receives the auxiliary data voltage from the auxiliary pixel RP through the auxiliary line RL. Accordingly, the auxiliary data converter 102 converts the auxiliary data RD by adding predetermined data to the auxiliary data RD, taking into consideration, for example, wire resistance of the auxiliary line RL and parasitic capacitance in the auxiliary line RL. The auxiliary data converter 102 outputs converted auxiliary data RD' to the memory 103. The auxiliary data converter 102 may be omitted. In this case, the auxiliary data calculating unit 101 outputs the auxiliary data RD to memory 103 (S104).

Third, the memory 103 receives and stores the converted auxiliary data RD' from the auxiliary data converter 102. When the auxiliary data converter 102 is omitted, the memory 103 receives and stores the auxiliary data from the auxiliary data calculating unit 101.

The memory 103 may be set to be updated to have initial data for every predetermined period. For example, the memory 103 may receive a signal indicating a predetermined period from the timing controller 60. The signal indicating the predetermined period may be, for example, a vertical sync signal (vsync) in which a pulse is generated for every one frame period, or a horizontal sync signal (hsync) in which a pulse is generated for every one horizontal frame period. The one frame period may be a period for which the data voltages are supplied to all of the display pixels DPs, and the one horizontal period be a period for which the data voltages are supplied to the display pixels DPs of any one row.

When the signal indicating a predetermined period is a vertical sync signal vsync, the memory 103 may be updated to have the initial data for every one frame period. When the signal indicating a predetermined period is a horizontal sync signal hsync, the memory 103 may be updated to have the initial data for every one horizontal period. The memory 103 may be implemented, for example, by a register. The memory 103 outputs data DD stored therein to the auxiliary data voltage converter 104 (S105).

Fourth, the auxiliary data voltage converter 104 receives the data DD stored in the memory 103 and converts the received data DD to an auxiliary data voltage. The auxiliary data voltage converter 104 synchronizes the auxiliary data voltages and the scan signals, respectively, and supplies the synchronized auxiliary data voltages to the auxiliary data lines RD1 and RD2. Accordingly, the auxiliary data voltages supplied to the auxiliary data lines RD1 and RD2 are synchronized with the data voltages supplied to the data lines D1 to Dm to be supplied. For example, the auxiliary data voltage supplied to the auxiliary pixel RP of the $p^{th}$ row is synchronized to the data voltages supplied to the display pixels DPs of the $p^{th}$ row to be supplied (S106).

In the present embodiment, the digital video data DATA corresponding to the coordinate value of the repaired pixel RDP1/RDP2 is the auxiliary data RD. As a result, the same auxiliary data voltage as the data voltage, which is to be supplied to the repaired pixel RDP1/RDP2, is supplied to the auxiliary pixel RP connected to the repaired pixel RDP1/RDP2.

Figure 4:
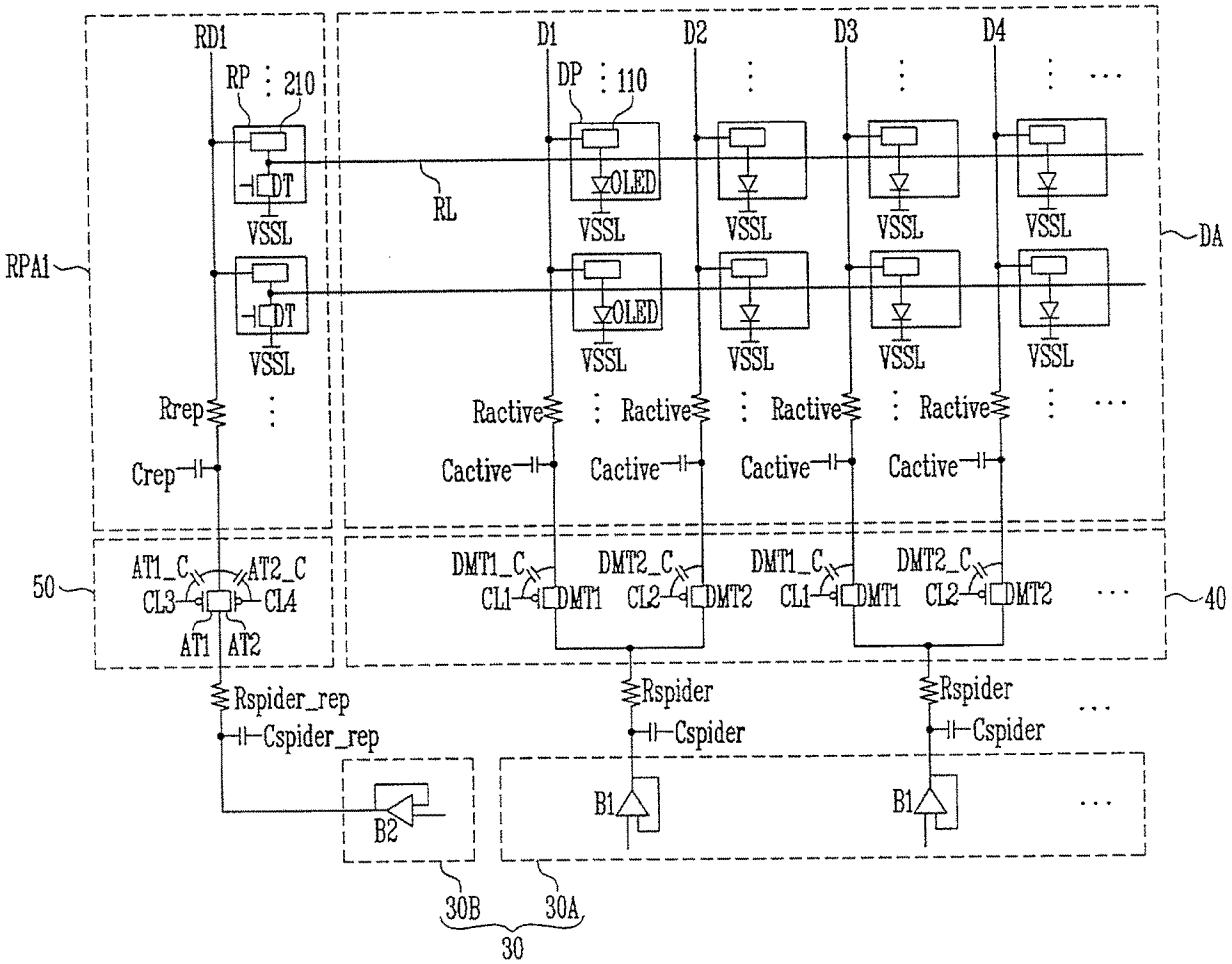
FIG. 4 illustrates an embodiment of output buffers of a first data driver, an output buffer of a second data driver, a demultiplexer, an auxiliary circuit unit, data lines, auxiliary data lines, display pixels, and auxiliary pixels.

FIG. 4 illustrates an embodiment of output buffers of the first data driver, an output buffer of the second data driver, a demultiplexer, an auxiliary circuit unit, data lines, auxiliary data lines, display pixels, and the auxiliary pixels. In FIG. 4, only the display pixels DPs, the auxiliary pixels RPs, the auxiliary lines RLs, the data lines D1 to D4, the auxiliary data line RD1, and the first and second data drivers 30A and 30B, the demultiplexer 40, and the auxiliary circuit unit of the display panel 10 are illustrated for convenience of the description.

In FIG. 4, the wiring resistance of each of the data lines D1 to D4 is indicated by "Ractive," its parasitic capacitance is indicated by "Cactive," wiring resistance of the auxiliary data line RD1 is indicated by "Rrep", and its parasitic capacitance is indicated by "Crep." Further, wiring resistance of a spider line SL between each output buffer B1 and the demultiplexer 40 of the first data driver 30A is indicated by "Rspider," parasitic capacitance thereof is indicated by "Cspider," wiring resistance of a spider line SL between each output buffer B1 and the auxiliary circuit unit 50 of the second data driver 30B is indicated by "Rspider_rep," and parasitic capacitance thereof is "Cspider_rep."

Referring to FIG. 4, the first data driver 30A outputs data voltages through the respective output buffers B1. Each output buffer B1 of the first data driver 30A is connected to the demultiplexer 40 through the spider line SL.

The second data driver 30B outputs auxiliary data voltages through the respective output buffers B2. Each output buffer B2 of the second data driver 30B is connected to the auxiliary circuit unit 50 through the spider line SL.

The demultiplexer 40 includes p demux transistors connected between the respective output buffers B1 of the first data driver 30A and the p data lines as in FIG. 4. In FIG. 4, two demux transistors DMT1 and DMT2 are connected the respective output buffers B1 of the data driver 30A and the two data lines. A different number of demux transistors may be connected to the respective output buffers and the data lines in another embodiment.

The first demux transistor DMT1 connects a $j^{th}$ data line (j is a positive integer satisfying $1 \leq j \leq m$) and the spider line SL according to a control signal of a first control line CL1. The first demux transistor DMT1 has a control electrode connected to the first control line CL1, a first electrode connected to the spider line SL, and a second electrode connected to the $j^{th}$ data line.

The second demux transistor DMT2 connects a data line adjacent to the $j^{th}$ data line and the spider line SL according to a control signal of a second control line CL2. The second demux transistor DMT2 has a control electrode connected to the second control line CL2, a first electrode connected to the spider line SL, and a second electrode connected to the data line adjacent to the $j^{th}$ data line. In FIG. 4, the $j^{th}$ data line is an odd-numbered data line and the data line adjacent to the $j^{th}$ line is an even numbered data line.

The auxiliary circuit unit 50 includes q auxiliary transistors connected between the respective output buffers B2 of the second data driver 30B and the first auxiliary data line RD1. In FIG. 4, two auxiliary transistors AT1 and AT2 are connected between the respective output buffers B2 of the second data driver 30B and the first auxiliary data line RD1. A different number of auxiliary transistors may be connected in another embodiment. For example, $p=q$ in one embodiment or $p \neq q$ in another embodiment.

The first auxiliary transistor AT1 connects the first auxiliary data line RD1 and the spider line SL according to a control signal of the third control line CL3. The first auxiliary transistor AT1 has a control electrode connected to the third control line CL3, a first electrode connected to the spider line SL, and a second electrode connected to the first auxiliary data line RD1.

The second auxiliary transistor AT2 connects the first auxiliary data line RD1 and the spider line SL according to a control signal of the fourth control line CL4. The second auxiliary transistor AT2 has a control electrode connected to the fourth control line CL4, a first electrode connected to the spider line SL, and a second electrode connected to the first auxiliary data line RD1.

Each of the data lines D1 to D4 is connected to the display pixel driver 110 of the display pixel DP. When a scan signal is supplied from the scan line, the display pixel driver 110 receives the data voltage from the data line and controls a driving current to flow from the first power voltage to the organic light emitting diode OLED according to the data voltage. For example, the display pixel driver 110 supplies a predetermined driving current to the organic light emitting diode OLED. The organic light emitting diode OLED of the display pixel DP emits light with predetermined luminance according to a driving current of the display pixel driver 110.

Each of the auxiliary data lines RD1 and RD2 is connected to the auxiliary pixel driver 210 of the auxiliary pixel RP. When a scan signal is supplied from the scan line, the auxiliary pixel driver 210 receives the auxiliary data voltage from the auxiliary data line and controls driving current to flow from the first power voltage to the organic light emitting diode OLED according to the auxiliary data voltage. The auxiliary pixel driver 210 supplies a predetermined driving current to the auxiliary line RL. The discharge transistor DT of the auxiliary pixel RP discharges the auxiliary line RL with the third power voltage. A control electrode of the discharge transistor DT may be connected to various signal lines.

The auxiliary line RL is connected to the auxiliary pixel RP and extends to the display area DA from the auxiliary pixel RP to cross the display pixels DPs. For example, as illustrated in FIG. 4, the auxiliary line RL may cross the anode electrodes of the organic light emitting diodes OLEDs of the display pixels DPs.

In the present embodiment, p demux transistors are connected between the respective output buffers B1 of the first data driver 30A and p data lines, and q auxiliary transistors are connected between the respective output buffers B2 of the second data driver 30B and the auxiliary data line RD1. In this example, $p=q$.

Further, the parasitic capacitance Crep of the auxiliary Data RD is substantially the same as the parasitic capacitance Cactive of each data line, and parasitic capacitance AT1_C and AT2_C of q auxiliary transistors AT1 and AT2 may be substantially the same as the parasitic capacitance DMT1_C and DMT2_C of p demux transistors DMT1 and DMT2. As a result, a coupling (which influences the auxiliary data voltage supplied to the auxiliary pixel RP by the parasitic capacitance Crep of the auxiliary data line RD1 and the parasitic capacitance AT1_C and AT2_C of q auxiliary transistors AT1 and AT2) may be substantially the same as a coupling (which influences the data voltage supplied to the display pixel DP by parasitic capacitance Cactive of each data line and the parasitic capacitance DMT1_C and DMT2_C of p demux transistors DMT1 and DMT2). As a result, when the auxiliary data voltage supplied to the repaired pixel through the auxiliary pixel RP is substantially the same as the data voltage supplied to each display pixel, it is possible to reduce or minimize a difference between the auxiliary data voltage and the data voltage by the coupling. Accordingly, it is possible to prevent generation of a difference in luminance between the repaired pixel and each display pixel.

Figure 5A:
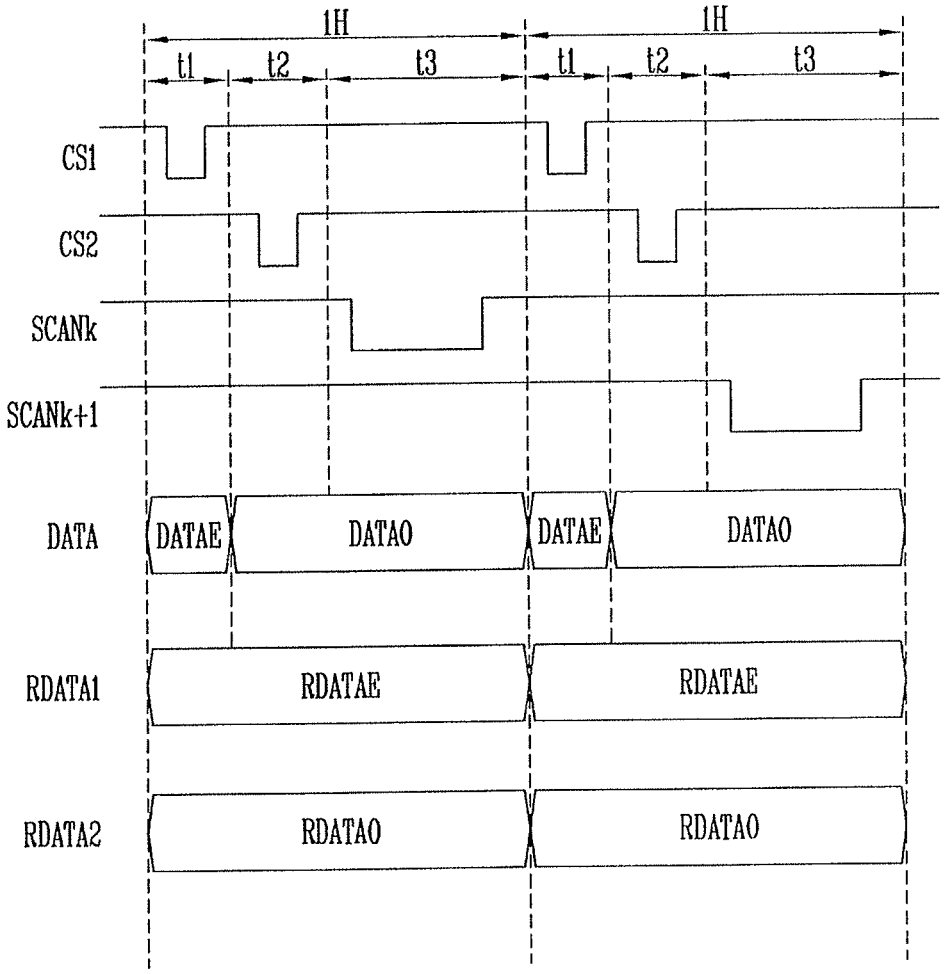
FIGS. 5A to 5D illustrate examples of first to fourth control signals supplied to first to fourth control lines, a $k^{th}$ scan signal supplied to a $k^{th}$ scan line, data voltages output from the output buffer of the first data driver and auxiliary data voltages output from the output buffer of the second data driver.

FIG. 5A illustrates an example of first to fourth control signals supplied to first to fourth control lines, a $k^{th}$ scan signal supplied to a $k^{th}$ scan line, a $k+1^{th}$ scan signal supplied to a $k+1^{th}$ scan line, data voltages output from the output buffer of the first data driver, and the auxiliary data voltages output from the output buffer of the second data driver of FIG. 4.

In particular FIG. 5A illustrates first to fourth control signals CS1 to CS4 supplied for one horizontal period 1H, a $k^{th}$ scan signal SCANk (k is a positive integer satisfying $1 \leq k \leq n$), a $k+1^{th}$ scan signal SCANk+1, data voltages DATA output from the output buffers B1 of the first data driver 30A, auxiliary data voltages RDATA1 output from the output buffers B2 of the second data driver when the display pixel DP connected to the even-numbered data line of FIG.

4 is repaired, and auxiliary data voltages RDATA2 output from the output buffers B2 of the second data driver when the display pixel DP connected to the odd-numbered data line of FIG. 4 is repaired. One horizontal period 1H may correspond to a period for supplying data voltages to the display pixels DPs and the auxiliary pixels RPs connected to any one scan line.

Referring to FIG. 5A, one horizontal period 1H includes first to third periods t1 to t3. The first period t1 indicates a period for which the data voltages are supplied to the even-numbered data lines. The second period t2 indicates a period for which the data voltages are supplied to the odd-numbered data lines. The third period t3 indicates a period for which the scan signal is supplied.

The first control signal CS1 is generated as a gate-on voltage Von for the first period t1. The second control signal CS2 is generated as a gate-on voltage Von for the second period t2. The first and second control signals CS1 and CS2 are generated on a cycle of the one horizontal period 1H. The first control signal CS1 is supplied to the first to third control lines CL1 and CL3, and the second control signal CS2 is supplied to the second and fourth control lines CL2 and CL4.

The $k^{th}$ and $k+1^{th}$ scan signals SCANk and SCANk+1 are generated as the gate-on voltages for the third period t3. In order to smoothly secure the third period t3 for which the scan signal is supplied, the $k^{th}$ and $k+1^{th}$ scan signals SCANk and SCANk+1 may overlap the second and fourth control signals CS2 and CS4 for a predetermined period. Each of the $k^{th}$ and $k+1^{th}$ scan signals SCANk and SCANk+1 is generated on the cycle of the one frame period.

Further, even-numbered data voltage DATAE is output from the output buffer B1 of the first data driver 30A for the first period t1, and odd-numbered data voltage DATAO is output from the output buffer B1 of the first data driver 30A for the second and third periods t2 and t3. When the display pixel DP connected to the even-numbered data line is repaired, an even-numbered auxiliary data voltage RDATAE corresponding to an even-numbered data voltage supplied to the repaired pixel is output from the output buffer B2 of the second data driver 30B for the first to third periods t1 to t3. When the display pixel DP connected to the odd-numbered data line is repaired, an odd-numbered auxiliary data voltage RDATAO corresponding to an odd-numbered data voltage supplied to the repaired pixel is output from the output buffer B2 of the second data driver 30B for the first to third periods t1 to t3.

An example of the operations of the demultiplexer 40, the auxiliary circuit unit 50, the display pixels DPs, and the auxiliary pixel RP for the first to third periods t1 to t3 are described with reference to FIGS. 4 and 6A.

First, the first and third control signals CS1 and CS3 are supplied as the gate-on voltages for the first period t1. Accordingly, when the second demux transistors DMT2 connected to the even-numbered data line D2 and D4 are turned on the first period t1, the even-numbered data voltage DATAE is supplied to the even-numbered data lines D2 and D4.

Further, the second auxiliary transistor AT2 connected to the auxiliary data line RD1 is turned on the first period t1. Thus, the auxiliary data voltage is supplied to the auxiliary data line RD1. When the display pixel DP connected to the even-numbered data line is repaired, the even-numbered auxiliary data voltage RDATAE is supplied to the auxiliary data line RD1 for the first period t1. When the display pixel DP connected to the odd-numbered data line is repaired, the odd-numbered auxiliary data voltage RDATAO is supplied to the auxiliary data line RD1 for the first period t1.

Second, the second and fourth control signals CS2 and CS4 are supplied as the gate-on voltages for the second period t2. Accordingly, the first demux transistors DMT1 connected to the odd-numbered data lines D1 and D3 are turned on the second period t2. Thus, the odd-numbered data voltage DATAO is supplied to the odd-numbered data lines D1 and D3.

Further, the first auxiliary transistor AT1 connected to the auxiliary data line RD1 is turned on the second period t2. Thus, the auxiliary data voltage is supplied to the auxiliary data line RD1. When the display pixel DP connected to the even-numbered data line is repaired, the even-numbered auxiliary data voltage RDATAE is supplied to the auxiliary data line RD1 for the second period t2. When the display pixel DP connected to the odd-numbered data line is repaired, the odd-numbered auxiliary data voltage RDATAO is supplied to the auxiliary data line RD1 for the second period t2.

Third, the $k^{th}$ scan signal SCANk is supplied as the gate on voltage Von for the third period t3. Accordingly, the display pixels DPs connected to the data lines D1 to D4 receive the data voltages from the data lines D1 to D4 for the third period t3. The display pixel driver 110 of the display pixel DP supplies the driving current to the organic light emitting diode OLED according to the data voltage. As a result, the organic light emitting diode OLED of the display pixel DP emits light.

Further, the auxiliary pixel RP connected to the auxiliary data line RD1 receives the auxiliary data voltage from the auxiliary data line RD1 for the third period t3. The auxiliary pixel driver 210 of the auxiliary pixel DP supplies the driving current to the auxiliary line RL according to the auxiliary data voltage. As a result, the organic light emitting diode OLED of the repaired pixel DP emits light.

Figure 5B:
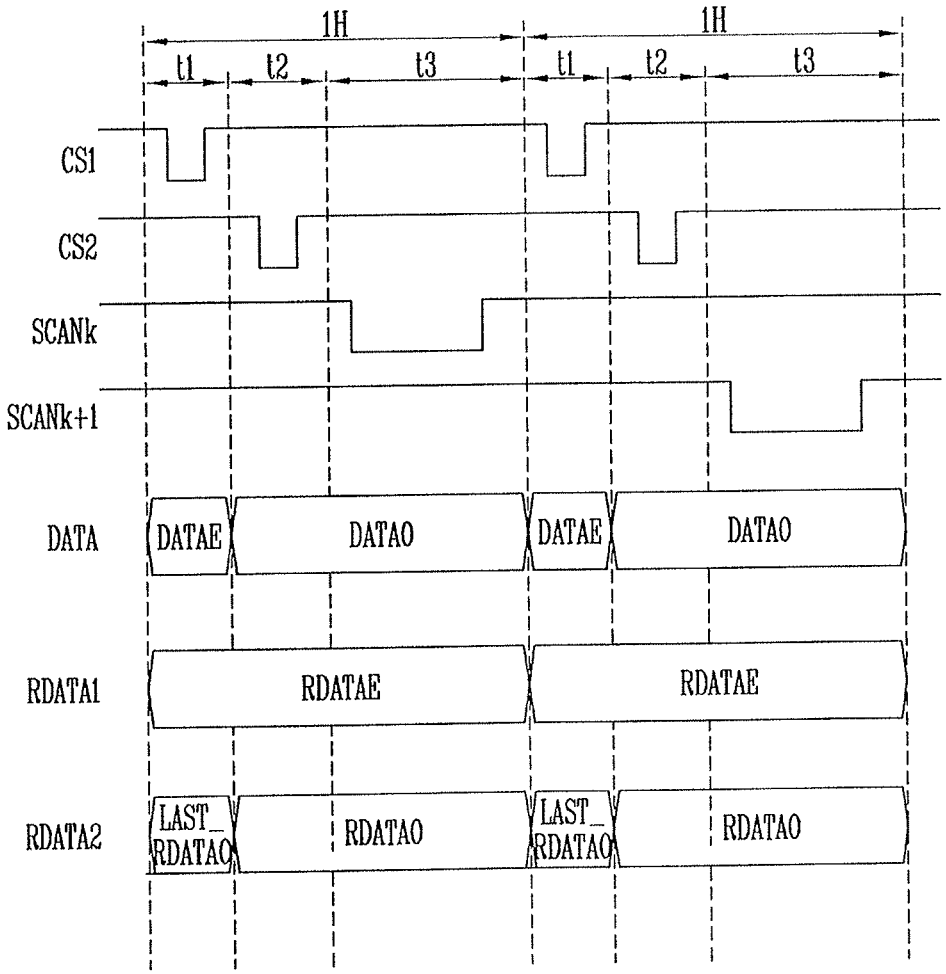

FIG. 5B illustrates another example of first to fourth control signals supplied to first to fourth control lines, a $k^{th}$ scan signal supplied to a $k^{th}$ scan line, a $k+1^{th}$ scan signal supplied to a $k+1^{th}$ scan line, data voltages output from the output buffer of the first data driver, and the auxiliary data voltages output from the output buffer of the second data driver of FIG. 4.

For example, FIG. 5B illustrates first to fourth control signals CS1 to CS4 supplied for one horizontal period (1H), $k^{th}$ and $k+1^{th}$ scan signals SCANk and SCANk+1, data voltages DATA output from the output buffers B1 of the first data driver 30A, auxiliary data voltages RDATA1 output from the output buffers B2 of the second data driver when the display pixel DP connected to the even-numbered data line of FIG. 4 is repaired, and auxiliary data voltages RDATA2 output from the output buffers B2 of the second data driver when the display pixel DP connected to the odd-numbered data line of FIG. 4 is repaired.

First to third periods t1 to t3, the first to fourth control signals CS1 and CS4, and the $k^{th}$ and $k+1^{th}$ scan signals SCANk and SCANk+1 in FIG. 5B are substantially the same as those described with reference to FIG. 5A.

When the display pixel DP connected to the even-numbered data line is repaired, an even-numbered auxiliary data voltage RDATAE corresponding to an even-numbered data voltage supplied to the repaired pixel is output from the output buffer B2 of the second data driver 30B for the first to third periods t1 to t3. When the display pixel DP connected to the odd-numbered data line is repaired, an odd-numbered auxiliary data voltage LAST_RDATAO corresponding to an odd-numbered data voltage supplied to the repaired pixel connected to a previous scan line of the $k^{th}$ scan line is output from the output buffer B2 of the second data driver 30B for the first period t1. The odd-numbered auxiliary data voltage RDATAO corresponding to the odd-numbered data voltage supplied to the repaired pixel connected to the $k^{th}$ scan line is output from the output buffer B2 of the second data driver 30B for the second and third periods t2 and t3.

An example of operations of the demultiplexer 40, the auxiliary circuit unit 50, the display pixels DPs, and the auxiliary pixel RP for the first to third periods t1 to t3 are described with reference to FIGS. 4 and 5B.

First, the first and third control signals CS1 and CS3 are supplied as the gate-on voltages for the first period t1. Accordingly, when the second demux transistors DMT2 connected to the even-numbered data lines D2 and D4 are turned on the first period t1, the even-numbered data voltage DATAE is supplied to the even numbered data lines D2 and D4.

Further, the second auxiliary transistor AT2 connected to the auxiliary data line RD1 is turned on the first period t1. Thus, the auxiliary data voltage is supplied to the auxiliary data line RD1. When the display pixel DP connected to the even-numbered data line is repaired, the even-numbered auxiliary data voltage RDATAE is supplied to the auxiliary data line RD1 for the first period t1. When the display pixel DP connected to the odd-numbered data line is repaired, the odd-numbered auxiliary data voltage LAST_RDATAO is supplied to the auxiliary data line RD1 for the first period t1.

Second, the second and fourth control signals CS2 and CS4 are supplied as the gate-on voltages for the second period t2. Accordingly, the first demux transistors DMT1 connected to the odd-numbered data lines D1 and D3 are turned on the second period t2. Thus, the odd-numbered data voltage DATAO is supplied to the odd-numbered data lines D1 and D3.

Further, the first auxiliary transistor AT1 connected to the auxiliary data line RD1 is turned on the second period t2. Thus, the auxiliary data voltage is supplied to the auxiliary data line RD1. When the display pixel DP connected to the even-numbered data line is repaired, the even-numbered auxiliary data voltage RDATAE is supplied to the auxiliary data line RD1 for the second period t2. When the display pixel DP connected to the odd-numbered data line is repaired, the odd-numbered auxiliary data voltage RDATAO is supplied to the auxiliary data line RD1 for the second period t2.

Third, the $k^{th}$ scan signal SCANk is supplied as the gate-on voltage Von for the third period t3. Accordingly, the display pixels DPs connected to the data lines D1 to D4 receive the data voltages from the data lines D1 to D4 for the third period t3. The display pixel driver 110 of the display pixel DP supplies the driving current to the organic light emitting diode OLED according to the data voltage. As a result, the organic light emitting diode OLED of the display pixel DP emits light.

Further, the auxiliary pixel RP connected to the auxiliary data line RD1 receives the auxiliary data voltage from the auxiliary data line RD1 for the third period t3. The auxiliary pixel driver 210 of the auxiliary pixel DP supplies the driving current to the auxiliary line RL according to the auxiliary data voltage. As a result, the organic light emitting diode OLED of the repaired pixel DP emits light.

Figure 5C:
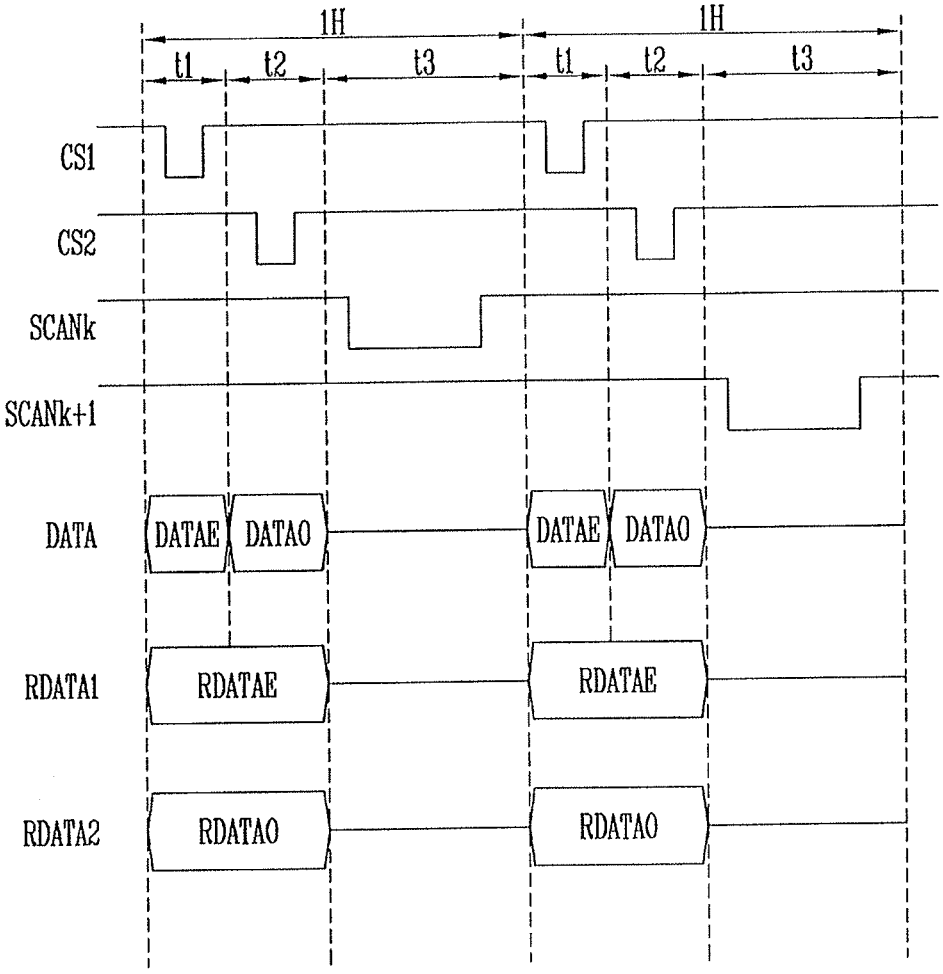

FIG. 5C illustrates another example of first to fourth control signals supplied to first to fourth control lines, a $k^{th}$ scan signal supplied to a $k^{th}$ scan line, a $k+1^{th}$ scan signal supplied to a $k+1^{th}$ scan line, data voltages output from the output buffer of the first data driver, and the auxiliary data voltages output from the output buffer of the second data driver of FIG. 4.

For example, FIG. 5C illustrates first to fourth control signals CS1 to CS4 supplied for one horizontal period (1H), $k^{th}$ and $k+1^{th}$ scan signals SCANk and SCANk+1, data voltages DATA output from the output buffers B1 of the first data driver 30A, auxiliary data voltages RDATA1 output from the output buffers B2 of the second data driver when the display pixel DP connected to the even-numbered data line of FIG. 4 is repaired, and auxiliary data voltages RDATA2 output from the output buffers B2 of the second data driver when the display pixel DP connected to the odd-numbered data line of FIG. 4 is repaired.

First to third periods t1 to t3, the first to fourth control signals CS1 and CS4, and the $k^{th}$ and $k+1^{th}$ scan signals SCANk and SCANk+1 in FIG. 5C are substantially the same as those described with reference to FIG. 5A.

When the display pixel DP connected to the even-numbered data line is repaired, an even-numbered auxiliary data voltage RDATAE corresponding to an even-numbered data voltage supplied to the repaired pixel is output from the output buffer B2 of the second data driver 30B for the first and second periods t1 and t2. Further, any data voltage is not output from the output buffer B2 of the second data driver 30B for the third period t3. For example, a spider line SL connected to the output buffer B2 of the second data driver 30B is floated.

When the display pixel DP connected to the odd-numbered data line is repaired, an odd-numbered auxiliary data voltage RDATAO corresponding to an odd-numbered data voltage supplied to the repaired pixel is output from the output buffer B2 of the second data driver 30B for the first and second periods t1 and t2. Further, any data voltage is not output from the output buffer B2 of the second data driver 30B for the third period t3. For example, a spider line SL connected to the output buffer B2 of the second data driver 30B is floated.

An example of operations of the demultiplexer 40, the auxiliary circuit unit 50, the display pixels DPs, and the auxiliary pixel RP for the first to third periods t1 to t3 are described with reference to FIGS. 4 and 5C.

First, the first and third control signals CS1 and CS3 are supplied as the gate-on voltages for the first period t1. Accordingly, when the second demux transistors DMT2 connected to the even-numbered data lines D2 and D4 are turned on the first period t1, the even-numbered data voltage DATAE is supplied to the even-numbered data lines D2 and D4.

Further, the second auxiliary transistor AT2 connected to the auxiliary data line RD1 is turned on the first period t1. Thus, the auxiliary data voltage is supplied to the auxiliary data line RD1. When the display pixel DP connected to the even-numbered data line is repaired, the even-numbered auxiliary data voltage RDATAE is supplied to the auxiliary data line RD1 for the first period t1. When the display pixel DP connected to the odd-numbered data line is repaired, the odd-numbered auxiliary data voltage RDATAO is supplied to the auxiliary data line RD1 for the first period t1.

Second, the second and fourth control signals CS2 and CS4 are supplied as the gate-on voltages for the second period t2. Accordingly, the first demux transistors DMT1 connected to the odd-numbered data lines D1 and D3 are turned on the second period t2, and thus the odd-numbered data voltage DATAO is supplied to the odd-numbered data lines D1 and D3.

Further, the first auxiliary transistor AT1 connected to the auxiliary data line RD1 is turned on the second period t2. Thus, the auxiliary data voltage is supplied to the auxiliary data line RD1. When the display pixel DP connected to the even-numbered data line is repaired, the even-numbered auxiliary data voltage RDATAE is supplied to the auxiliary data line RD1 for the second period t2, and when the display pixel DP connected to the odd-numbered data line is repaired, the odd-numbered auxiliary data voltage RDATAO is supplied to the auxiliary data line RD1 for the second period t2.

Third, the $k^{th}$ scan signal SCANk is supplied as the gate-on voltage Von for the third period t3. Accordingly, the display pixels DPs connected to the data lines D1 to D4 receive the data voltages from the data lines D1 to D4 for the third period t3. The display pixel driver 110 of the display pixel DP supplies the driving current to the organic light emitting diode OLED according to the data voltage. As a result, the organic light emitting diode OLED of the display pixel DP emits light.

Further, the auxiliary pixel RP connected to the auxiliary data line RD1 receives the auxiliary data voltage from the auxiliary data line RD1 for the third period t3. The auxiliary pixel driver 210 of the auxiliary pixel DP supplies the driving current to the auxiliary line RL according to the auxiliary data voltage. As a result, the organic light emitting diode OLED of the repaired pixel DP emits light.

Figure 5D:
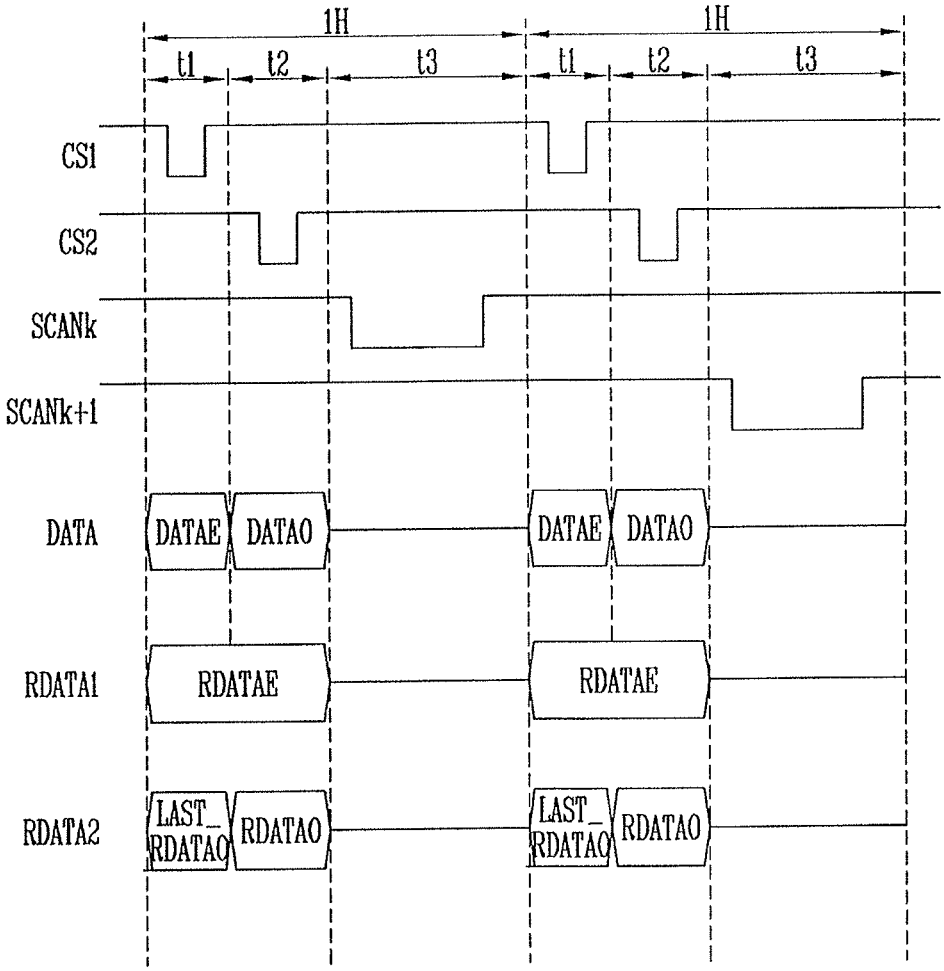

FIG. 5D illustrates another example of first to fourth control signals supplied to first to fourth control lines, a $k^{th}$ scan signal supplied to a $k^{th}$ scan line, a $k+1^{th}$ scan signal supplied to a $k+1^{th}$ scan line, data voltages output from the output buffer of the first data driver, and the auxiliary data voltages output from the output buffer of the second data driver of FIG. 4.

For example, FIG. 5D illustrates first to fourth control signals CS1 to CS4 supplied for one horizontal period (1H), $k^{th}$ and $k+1^{th}$ scan signals SCANk and SCANk+1, data voltages DATA output from the output buffers B1 of the first data driver 30A, auxiliary data voltages RDATA1 output from the output buffers B2 of the second data driver when the display pixel DP connected to the even-numbered data line of FIG. 4 is repaired, and auxiliary data voltages RDATA2 output from the output buffers B2 of the second data driver when the display pixel DP connected to the odd-numbered data line of FIG. 4 is repaired.

First to third periods t1 to t3, the first to fourth control signals CS1 and CS4, and the $k^{th}$ and $k+1^{th}$ scan signals SCANk and SCANk+1 in FIG. 5D are substantially the same as those described with reference to FIG. 5A.

When the display pixel DP connected to the even-numbered data line is repaired, an even-numbered auxiliary data voltage RDATAE corresponding to an even-numbered data voltage supplied to the repaired pixel is output from the output buffer B1 of the second data driver 30B for the first and second periods t1 and t2. Further, any data voltage is not output from the output buffer B2 of the second data driver 30B for the third period t3. For example, a spider line SL connected to the output buffer B2 of the second data driver 30B is floated.

When the display pixel DP connected to the odd-numbered data line is repaired, an odd-numbered auxiliary data voltage LAST_RDATAO corresponding to an odd-numbered data voltage supplied to the repaired pixel connected to a previous scan line of the $k^{th}$ scan line is output from the output buffer B2 of the second data driver 30B for the first period t1. The odd-numbered auxiliary data voltage RDATAO corresponding to the odd-numbered data voltage supplied to the repaired pixel connected to the $k^{th}$ scan line is output from the output buffer B2 of the second data driver 30B for the second period t2. Further, any data voltage is not output from the output buffer B2 of the second data driver 30B for the third period t3. For example, a spider line SL connected to the ouput buffer B2 of the second data driver 30B is floated.

An example of operations of the demultiplexer 40, the auxiliary circuit unit 50, the display pixels DPs, and the auxiliary pixel RP for the first to third periods t1 to t3 are described with reference to FIGS. 4 and 5D.

First, the first and third control signals CS1 and CS3 are supplied as the gate-on voltages for the first period t1. Accordingly, the second demux transistors DMT2 connected to the even-numbered data lines D2 and D4 are turned on the first period t1, and thus the even-numbered data voltage DATAE is supplied to the even-numbered data lines D2 and D4.

Further, the second auxiliary transistor AT2 connected to the auxiliary data line RD1 is turned on the first period t1, and thus, the auxiliary data voltage is supplied to the auxiliary data line RD1. When the display pixel DP connected to the even-numbered data line is repaired, the even-numbered auxiliary data voltage RDATAE is supplied to the auxiliary data line RD1 for the first period t1. When the display pixel DP connected to the odd-numbered data line is repaired, the odd-numbered auxiliary data voltage LAST_RDATAO is supplied to the auxiliary data line RD1 for the first period t1.

Second, the second and fourth control signals CS2 and CS4 are supplied as the gate-on voltages for the second period t2. Accordingly, the first demux transistors DMT1 connected to the odd-numbered data lines D1 and D3 are turned on the second period t2, and thus the odd-numbered data voltage DATAO is supplied to the odd-numbered data lines D1 and D3.

Further, the first auxiliary transistor AT1 connected to the auxiliary data line RD1 is turned on the second period t2. Thus, the auxiliary data voltage is supplied to the auxiliary data line RD1. When the display pixel DP connected to the even-numbered data line is repaired, the even-numbered auxiliary data voltage RDATAE is supplied to the auxiliary data line RD1 for the second period t2. When the display pixel DP connected to the odd-numbered data line is repaired, the odd-numbered auxiliary data voltage RDATAO is supplied to the auxiliary data line RD1 for the second period t2.

Third, the $k^{th}$ scan signal SCANk is supplied as the gate-on voltage Von for the third period t3. Accordingly, the display pixels DPs connected to the data lines D1 to D4 receive the data voltages from the data lines D1 to D4 for the third period t3. The display pixel driver 110 of the display pixel DP supplies the driving current to the organic light emitting diode OLED according to the data voltage. As a result, the organic light emitting diode OLED of the display pixel DP emits light.

Further, the auxiliary pixel RP connected to the auxiliary data line RD1 receives the auxiliary data voltage from the auxiliary data line RD1 for the third period t3. The auxiliary pixel driver 210 of the auxiliary pixel DP supplies the driving current to the auxiliary line RL according to the auxiliary data voltage. As a result, the organic light emitting diode OLED of the repaired pixel DP emits light.

Figure 6:
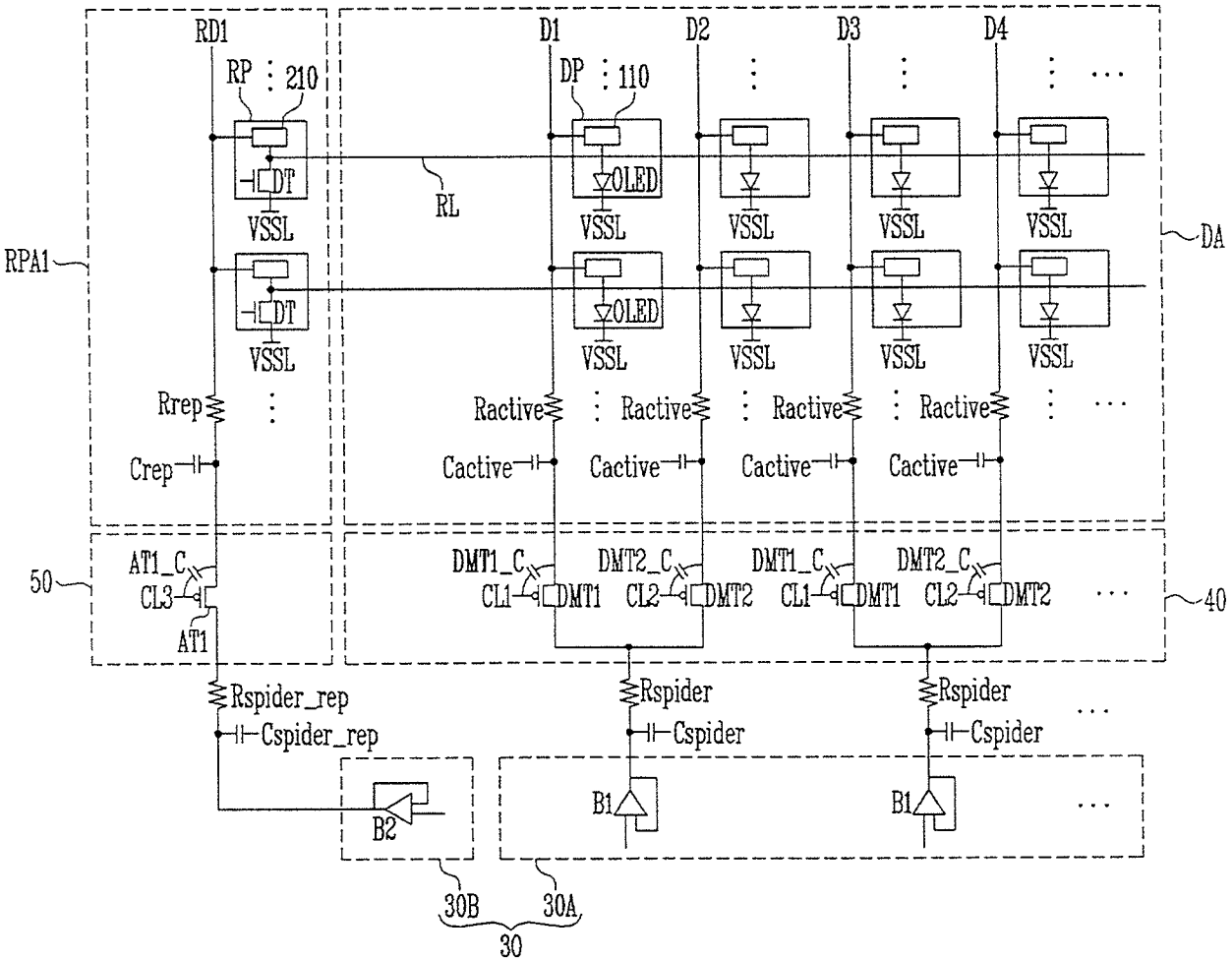
FIG. 6 illustrates another embodiment of output buffers of a first data driver, an output buffer of a second data driver, a demultiplexer, an auxiliary circuit unit, data lines, auxiliary data lines, display pixels, and auxiliary pixels.

FIG. 6 illustrates another embodiment of output buffers of a first data driver, an output buffer of a second data driver, a demultiplexer, an auxiliary circuit unit, data lines, auxiliary data lines, display pixels, and auxiliary pixels In FIG. 6, only the display pixels DPs, the auxiliary pixels RPs, the auxiliary lines RLs, the data lines D1 to D4, the auxiliary data line RD1, the first and second data drivers 30A and 30B, the demultiplexer 40, and the auxiliary circuit unit 50 of the display panel 10 are illustrated for convenience of the description. Further, in FIG. 6, wiring resistance of each of the data lines D1 to D4 is indicated by "Ractive," its parasitic capacitance is indicated by "Cactive," resistance of each of the auxiliary data line RD1 is indicated by "Rrep," and its parasitic capacitance thereof is indicated by "Crep." Further, wiring resistance of a spider line SL between each output buffer B1 of the first data driver 30A and the demultiplexer 40 is indicated by "Rspider," its parasitic capacitance is indicated by "Cspider," wiring resistance of a spider line SL between each output buffer Bb of the second data driver 30B and the auxiliary circuit unit 50 is indicated by "Rspider_rep," and its parasitic capacitance is indicated by "Cspider_rep."

The first data driver 30A, the second data driver 30B, the demultiplexer 40, the data lines D1 to D4, the first auxiliary data line RD1, the display pixels DPs, and the auxiliary pixels RPs in FIG. 6 are substantially the same as those described with reference to FIG. 4.

The auxiliary circuit unit 50 includes q auxiliary transistors connected between the respective output buffers B2 of the second data driver 30B and the first auxiliary data line RD1. In FIG. 4, one auxiliary transistor AT1 is connected between each output buffer B2 of the second data driver 30B and the first auxiliary data line RD1. In another embodiment, $p \neq q$.

The first auxiliary transistor Art connects the first auxiliary data line RD1 and the spider line SL according to a control signal of the third control line CL3. The first auxiliary transistor AT1 has a control electrode connected to the third control line CL3, a first electrode connected to the spider line SL, and a second electrode connected to the first auxiliary data line RD1.

In this embodiment, p demux transistors are connected between each output buffer B1 of the first data driver 30A and p data lines, and one auxiliary transistor is connected between each output buffer B2 of the second data driver 30B and the auxiliary data line RD1. In another embodiment, the parasitic capacitance Crep of the auxiliary data line RD1 may be substantially the same as the parasitic capacitance Cactive of each data line, and parasitic capacitance AT1_C of the first auxiliary transistor AT1 may be substantially the same as the parasitic capacitance DMT1_C and DMT2_C of p demux transistors DMT1 and DMT2.

As a result, a coupling (which influences the auxiliary data voltage supplied to the auxiliary pixel RP by the parasitic capacitance Crep of the auxiliary data line RD1 and the parasitic capacitance AT1_C of the first auxiliary transistor AT1) may be substantially the same as a coupling (which influences the data voltage supplied to the display pixel DP by the parasitic capacitance Cactive of each data line and the parasitic capacitance DMT1_C and DMT2_C of p demux transistors DMT1 and DMT2). Thus, when the auxiliary data voltage supplied to the repaired pixel through the auxiliary pixel RP is substantially the same as the data voltage supplied to each display pixel, it is possible to reduce or minimize a difference between the auxiliary data voltage and the data voltage by the coupling. Accordingly, it is possible to reduce or prevent generation of a difference in luminance between the repaired pixel and each display pixel.

The exemplary embodiment in FIG. 6 may be operated by waveform diagrams in FIGS. 5A to 5D. However, when the exemplary embodiment is operated by the waveform diagrams illustrated in FIGS. 5A and 5C, the third control signal CS3 may be supplied to the third control line CL3. When the exemplary embodiment is operated by the waveform diagrams in FIGS. 5B and 5D, the fourth control signal CS4, not the third control signal CS3, may be supplied to the third control line CL3.

Figure 7:
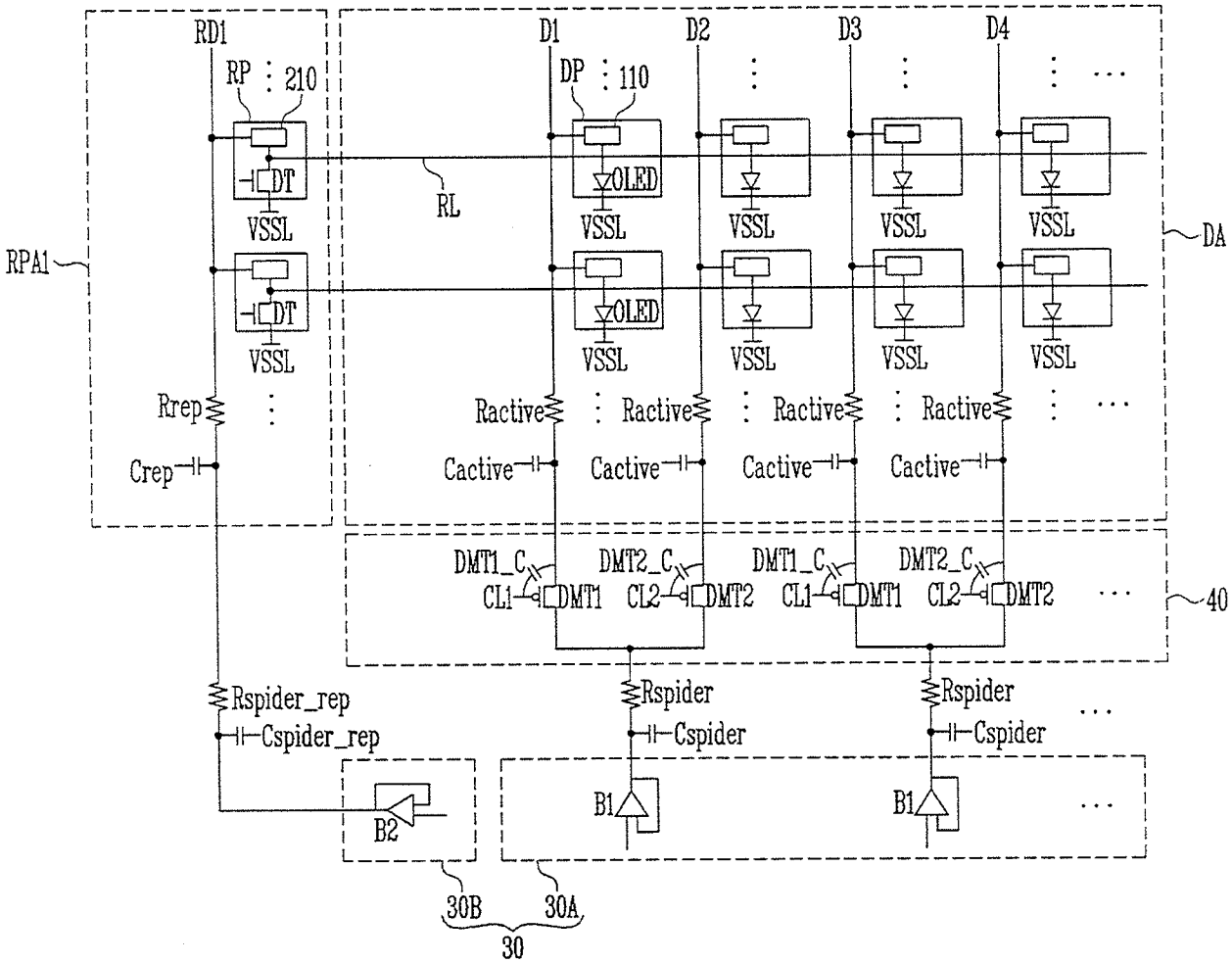
FIG. 7 illustrates another embodiment of output buffers of a first data driver, an output buffer of a second data driver, a demultiplexer, an auxiliary circuit unit, data lines, auxiliary data lines, display pixels, and auxiliary pixels.

FIG. 7 illustrating another embodiment of output buffers of a first data driver, an output buffer of a second data driver, a demultiplexer, data lines, auxiliary data lines, display pixels, and auxiliary pixels. In FIG. 7, only the display pixels DPs, the auxiliary pixels RPs, the auxiliary lines RLs, the data lines D1 to D4, the auxiliary data line RD1, the first and second data drivers 30A and 30B, and the demultiplexer 40 of the display panel 10 are illustrated for convenience of the description.

Further, in FIG. 7, wiring resistance of each of the data lines D1 to D4 is indicated by "Ractive," its parasitic capacitance is indicated by "Cactive," resistance of each of the auxiliary data line RD1 is indicated by "Rrep," and its parasitic capacitance thereof is indicated by "Crep." Further, wiring resistance of a spider line SL between each output buffer B1 of the first data driver 30A and the demultiplexer 40 is indicated by "Rspider," its parasitic capacitance is indicated by "Cspider," wiring resistance of a spider line SL between each output buffer Bb of the second data driver 30B and the auxiliary circuit unit 50 is indicated by "Rspider_rep," and its parasitic capacitance is indicated by "Cspider_rep."

The first data driver 30A, the second data driver 30B, the demultiplexer 40, the data lines D1 to D4, the first auxiliary data line RD1, the display pixels DPs, and the auxiliary pixels RPs in FIG. 7 are substantially the same as those described with reference to FIG. 4.

In one embodiment, p demux transistors are connected between each output buffer B1 of the first data driver 30A and p data lines, and an auxiliary circuit unit 50 is not formed between each output buffer B2 of the second data driver 30B and the auxiliary data line RD1. In this case, even though the parasitic capacitance Crep of the auxiliary data line RD1 may be substantially the same as the parasitic capacitance Cactive of each data line, the data voltage supplied to the display pixel DP is influenced by coupling of the parasitic capacitance DMT1_C and DMT2_C of p demux transistors DMT1 and DMT2, and the auxiliary data voltage supplied to the auxiliary pixel RP is influenced by coupling of the parasitic capacitance Cspider_rep of the spider line SL. Accordingly, a difference is generated between the data voltage supplied to the display pixel DP and the auxiliary data voltage supplied to the auxiliary pixel RP.

In order to reduce or minimize the difference between the data voltage supplied to the display pixel DP and the auxiliary data voltage supplied to the auxiliary pixel RP, the parasitic capacitance DMT1_C and DMT2_C of p demux transistors DMT1 and DMT2 may be less than the parasitic capacitance Cactive of each data line. Also, the parasitic capacitance Cspider_rep of the spider line SL may be less than the parasitic capacitance Crep of the auxiliary data line RD1.

In one embodiment, a sum of the parasitic capacitance DMT1_C and DMT2_C of p demux transistors DMT1 and DMT2 and the parasitic capacitance Cactive of each data line may be substantially the same as the parasitic capacitance Cspider_rep of the spider line SL and the parasitic capacitance Crep of the auxiliary data line RD1.

As a result, when the auxiliary data voltage supplied to the repaired pixel through the auxiliary pixel RP is substantially the same as the data voltage supplied to each display pixel, it is possible to reduce or minimize a difference between the auxiliary data voltage and the data voltage by the coupling. Accordingly, it is possible to reduce or prevent generation of a difference in luminance between the repaired pixel and each display pixel.

The exemplary embodiment in FIG. 7 may be operated by waveform diagrams illustrated in FIGS. 5C and 5D.

By way of summation and review, methods have been proposed for repairing defective pixels. However, these methods have drawbacks, not the least of which include a difference in the luminance of light emitted from the repaired pixel and the display pixel. In accordance with one or more of the aforementioned embodiments, an organic light emitting display device reduces or prevents a difference in luminance between a repaired pixel and a display pixel.

In one embodiment, p demux transistors are connected between each output buffer of the first data driver and p date lines, and q auxiliary transistors are connected between each output buffer of the second data driver and the auxiliary data line. In this case, p and q, which are positive integers equal to or greater than 2, it may be that p=q, or p is a positive integer equal to or greater than 2, and q=1.

Further, in one embodiment, parasitic capacitance of the data line may be substantially the same as parasitic capacitance of each data line, and parasitic capacitance of q auxiliary transistors may be substantially the same as parasitic capacitance of p demux transistors. As a result, coupling (which influences the auxiliary data voltage supplied to the auxiliary pixel by the parasitic capacitance of the auxiliary data line and the parasitic capacitance of q auxiliary transistors) may be substantially the same as coupling (which influences the data voltage supplied to the display pixel by parasitic capacitance of each data line and the parasitic capacitance of p demux transistors).

When the auxiliary data voltage supplied to the repaired pixel through the auxiliary pixel is substantially the same as the data voltage supplied to each display pixel, it is possible to reduce or minimize a difference between the auxiliary data voltage and the data voltage by the coupling. Accordingly, it is possible to reduce or prevent a difference in luminance between the repaired pixel and each display pixel.

Further, in one embodiment, p demux transistors are connected between each output buffer of the first data driver and p date lines, and an auxiliary circuit unit is not formed between each output buffer of the second data driver and the auxiliary data line. In this case, p may be a positive integer equal to or greater than 2. In this case, in order to reduce or minimize the difference between the data voltage supplied to the display pixel and the auxiliary data voltage supplied to the auxiliary pixel, the parasitic capacitance of each of the p demux transistors may be less than the parasitic capacitance of each data line, and the parasitic capacitance of the spider line may be less than the parasitic capacitance of the auxiliary data line.

Otherwise, the sum of the parasitic capacitance of p demux transistors and the parasitic capacitance of each data line may be substantially the same as the parasitic capacitance of the spider line and the parasitic capacitance of the auxiliary data line.

When the auxiliary data voltage supplied to the repaired pixel through the auxiliary pixel is substantially the same as the data voltage supplied to each display pixel, it is possible to reduce or minimize a difference between the auxiliary data voltage and the data voltage by the coupling. Accordingly, it is possible to reduce or prevent a difference in luminance between the repaired pixel and each display pixel.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims. Embodiments may be combined to form additional embodiments.

What is claimed is:

1. An apparatus, comprising:

a first data driver to supply data voltage to one data line;

a second data driver to supply an auxiliary data voltage to one auxiliary data line;

a display pixel connected to the one data line, two scan lines, and one emission control line;

an auxiliary pixel connected to the one auxiliary data line, two scan lines, and one emission control line, a demultiplexer between the one data line and the first data driver, and an auxiliary circuit between the one auxiliary data line and the second data driver, the auxiliary circuit including one or more auxiliary transistors connected between the one auxiliary data line and an output buffer of the second data driver, wherein a coupling capacitance between the second data driver and the auxiliary pixel is substantially equal to a coupling capacitance between the first data driver and the display pixel, and wherein the auxiliary pixel is to control emission of light from the display pixel when the display pixel is defective.

2. The apparatus as claimed in claim 1, further comprising:

an auxiliary line to connect to the display pixel to the auxiliary pixel, wherein the auxiliary line is to transfer a signal to the display pixel when a pixel circuit of the display pixel is disconnected from a light emitter of the display pixel, the signal to cause the display pixel to emit light.

3. The apparatus as claimed in claim 1, wherein the one auxiliary data line is to transfer auxiliary data to the auxiliary pixel when the display pixel is defective, the auxiliary data to be generated based on digital video data and coordinate data of the display pixel.

4. The apparatus as claimed in claim 1, wherein:

the coupling capacitance between the second data driver and the auxiliary pixel is a parasitic capacitance of the one auxiliary data line connected to the auxiliary pixel, and the coupling capacitance between the first data driver and the display pixel is a parasitic capacitance of the one data line connected to the display pixel.

5. The apparatus as claimed in claim 1, wherein:

the coupling capacitance between the second data driver and the auxiliary pixel is a parasitic capacitance corresponding to one or more transistors between the second data driver and the auxiliary pixel, and the coupling capacitance between the first data driver and the display pixel is a parasitic capacitance corresponding to one or more transistors between the first data driver and the display pixel.

* * * * *